US010611527B2

(12) United States Patent
Roehrich et al.

(10) Patent No.: US 10,611,527 B2
(45) Date of Patent: Apr. 7, 2020

(54) CONTAINER SYSTEM

(71) Applicant: Parker Hannifin EMEA S.à.r.l, Etoy (CH)

(72) Inventors: Berthold Roehrich, Nordheim (DE); Pekka Lehtinen, Ludwigsburg (DE)

(73) Assignee: Parker Hannifin EMEA S.A.R.L., La Tuiliere (CH)

( * ) Notice: Subject to any disclaimer, the term of this patent is extended or adjusted under 35 U.S.C. 154(b) by 73 days.

(21) Appl. No.: 15/896,279

(22) Filed: Feb. 14, 2018

(65) Prior Publication Data

US 2019/0055067 A1 Feb. 21, 2019

Related U.S. Application Data

(60) Provisional application No. 62/463,754, filed on Feb. 27, 2017.

(51) Int. Cl.

| | |
|---|---|
| ***B65D 41/28*** | (2006.01) |
| ***B65D 45/08*** | (2006.01) |
| *B65D 39/00* | (2006.01) |

(52) U.S. Cl.

CPC ..... *B65D 41/28* (2013.01); *B65D 45/08* (2013.01); *B65D 39/0029* (2013.01);

(Continued)

(58) Field of Classification Search

CPC ..... B65D 41/00–28; B65D 45/00–08; B65D 2539/00–003; B65D 39/00–0029; B65D 2251/00–0075

See application file for complete search history.

(56) References Cited

U.S. PATENT DOCUMENTS 4,534,482 A * 8/1985 Bouche ..... B65D 45/322 215/272
6,213,323 B1 * 4/2001 Ferrari ..... B65D 45/22 215/272

(Continued)

FOREIGN PATENT DOCUMENTS

| | | |
|---|---|---|
| GB | 199957 | 7/1923 |
| WO | 2009018192 | 2/2009 |

OTHER PUBLICATIONS

European Search Report for EP 18158459.0 dated Jun. 21, 2018.

(Continued)

*Primary Examiner* — Kareen K Thomas

(57) ABSTRACT

A container system for liquids includes a container body with a mouth, a resilient stopper and a cap. The stopper has a body portion closely received within the mouth, and an annular flange projecting radially outward from the body. A resilient annular spring element is located between the flange of the stopper and the cap, and biases the flange against the mouth of the container when the container is assembled and maintains a seal between the flange and cap. In one embodiment, the spring element has a unitary, tear-drop shaped geometry in cross-section with a rounded bulbous body portion smoothly tapering to a curved, radially-inwardly projecting lip, although the spring element could have other asymmetrical configurations such as a cone, helical, V, S or C shape in cross-section. The spring element defines at least two separate points of contact between the flange of the stopper and cap.

39 Claims, 6 Drawing Sheets

(52) U.S. Cl.
CPC ..... *B65D 2251/0015* (2013.01); *B65D 2251/0075* (2013.01); *B65D 2539/003* (2013.01)

(56) References Cited

U.S. PATENT DOCUMENTS

| | | | | |
|---|---|---|---|---|
| 6,651,834 | B2 * | 11/2003 | Wong | B65D 79/005 116/266 |
| 7,278,547 | B2 * | 10/2007 | Hagano | B60K 15/0406 215/301 |
| 2005/0121406 | A1 | 6/2005 | Brozell | |
| 2007/0212050 | A1 * | 9/2007 | Chiang | G02B 7/08 396/144 |
| 2019/0009041 | A1 * | 1/2019 | Khanom | F16K 15/063 |

OTHER PUBLICATIONS

Communication under Rule 71(3) EPC for European Patent Application 1815849.0 dated Jul. 16, 2019.
Text for Grant for European Patent Application 1815849.0 dated Jul. 16, 2019.

* cited by examiner

CONTAINER SYSTEM

FIELD OF THE INVENTION

The present invention relates generally to a container system for liquids, for example for biological or pharmaceutical applications, and a method for assembling such a container system.

BACKGROUND OF THE INVENTION

Certain container systems for storing and transporting liquids for biological or pharmaceutical applications include a container body with an elongated neck having an open mouth, a stopper formed from a resilient, pliable elastomeric material which is closely received at least partially within the mouth, and a cup-shaped cap which is secured over the mouth, such as by a screw connection, and retains the stopper on the container. The stopper can include an annular, radially-outwardly projecting flange which is captured between the inner surface of the cap and the distal end of the mouth when the cap is screwed down to prevent leakage. It is also known to provide an O-ring seal between the stopper and the mouth of the container, either between the outer diameter of the stopper and the inner diameter of the mouth, or between the axially-inwardly facing surface of the flange of the stopper and the distal open end of the mouth. The stopper can also have one or more radial ribs circumscribing the outer surface of the body of the stopper that sealingly press against the inner surface of the mouth.

The cap includes a central opening in its end, which enables flexible tubing to be inserted into through-holes in the stopper to enable liquid to be introduced and withdrawn from the container. During use, the liquid is introduced under aseptic conditions through a feed tube into a cleaned and sterilized container, with a vent tube enabling air within the container to escape. The tubes are then closed, a protective over cap is applied to the cap, and the container can be irradiated (if appropriate) and frozen for storage and transport. When it is desired to remove the contents of the container, the container is thawed, the tubes are opened, and the liquid is recovered.

The stopper, cap, tubing and container are typically formed of materials which are non-reactive to the liquids being stored and transported, and can withstand many of the typical operating conditions so that the contents of the container remain sterile and do not leak. Typical materials for the stopper include resilient thermoplastics and elastomers such as Thermoplastic Elastomers (TPE) or silicone. Typical materials for the tubing include TPE and silicone or equivalent, while typical materials for the container include plastic such as polycarbonate or polyethylene (e.g., Nalgene®), in a rigid (e.g., bottle-shaped) or flexible (e.g., a bag) form. The cap can be formed of a polymer such as plastic, elastomer, or other appropriate material.

One or more of the stopper, tubing, container and cap can be cleaned and reused if appropriate, but are typically disposed after a single use.

Such a container has received acceptance in the industry as being relatively simple to manufacture and assemble, inexpensive, and reliable as far as storing and transporting liquids.

Nevertheless, it has been found that during particularly low temperature storage and transport, such as when the container is stored and transported at temperatures between −70° C. to −120° C., the stopper can contract and enable liquid to leak from the container between the sides of the stopper and the neck of the container, up between the distal end of the mouth and the flange of the stopper, and between the flange and the inside surface of the cap. Such leakage can be undesirable, particularly when the container is cycled between low temperatures and ambient.

Thus, it is believed there is a demand for an improved container system, such as a container system which does not allow liquid to leak from the system during storage and transport at very low temperatures, and during cycling of the container between low temperatures and ambient.

SUMMARY OF THE INVENTION

A container system for liquids is provided which has an improved seal between the stopper and container to prevent leakage during low temperature storage and transport, and cycling of the container between low temperatures and ambient during use. The container system remains relatively simple to manufacture and assemble, and inexpensive to construct.

The system includes a container body having an elongated neck with an open mouth, a resilient stopper, and a cap with a central opening. The stopper has a body portion closely received within the neck and has optional sealing ribs, and a radial flange which is located between the distal end of the mouth and the cap. The flange has an axially-outward facing surface, which together with an axially-inwardly facing surface of the cap, defines a channel.

An annular spring element is located in the channel between the cap and stopper, and according to one embodiment, has a unitary, tear-drop shaped geometry in cross-section, with a rounded bulbous body portion smoothly tapering to a curved, radially-inwardly projecting lip. According to other embodiments, the seal can have a cone, helical, "V", "S", "C" or other appropriate, preferably asymmetrical shape which provides a bias against the flange of the stopper when the cap is screwed down onto the container.

The spring element is preferably comprised of a resilient, high-performance thermoplastic polymer, such as polyketone or similar material such as polyether ether ketone, polyphenylsulfone or polycarbonate, which is capable of maintaining its pliancy and shape over a wide temperature range. The spring element is located such that the element has at least an inner surface or edge sealingly engaged with the axially-outward facing surface of the flange, and an outer surface or edge sealingly engaged with the axially inwardly-facing surface of the cap. The spring element defines at least two, and preferably three separate points of contact between the stopper and cap within the channel.

When the container system is assembled, the stopper is inserted into the mouth of the container with the flange located against the distal end of the mouth. The distal end of the stopper extends outwardly a short distance from the container body. The spring element is located in the cap against the axially-inwardly facing surface, and when the cap is screwed down onto the neck of the container, the cap captures the flange between the inner axial surface of the cap and the distal end of the mouth. The cap also compresses the spring element within the channel between the cap and the flange when the cap is screwed down, which causes the spring element to compressively urge the stopper inwardly against the mouth of the container, and hence the flange against the distal end of the mouth. The resiliency of the spring element maintains the seal between the flange of the stopper and the mouth of the container, and provides a seal between the flange and the inside surface of the cap, even during low temperatures and cycling over a wide temperature range.

One or more tubes can be received in through-holes in the stopper in fluid-tight relationship therewith to enable fluid to be introduced and/or removed from the container body as appropriate.

Thus, as described above, a container system for liquids is provided which has an improved seal between the stopper and container which prevents leakage during low temperature storage and transport, and later use at ambient temperatures. The container system remains simple to manufacture and assemble, and relatively inexpensive to construct, as the stopper can continue to be made of low-cost, non-reactive resilient material, such as silicone or equivalent; while the spring element can be separately formed in different configurations and out of more expensive, high-performance materials, but overall, the system is capable of meeting the operational requirements of many biological and pharmaceutical applications.

DETAILED DESCRIPTION

Figure 1:
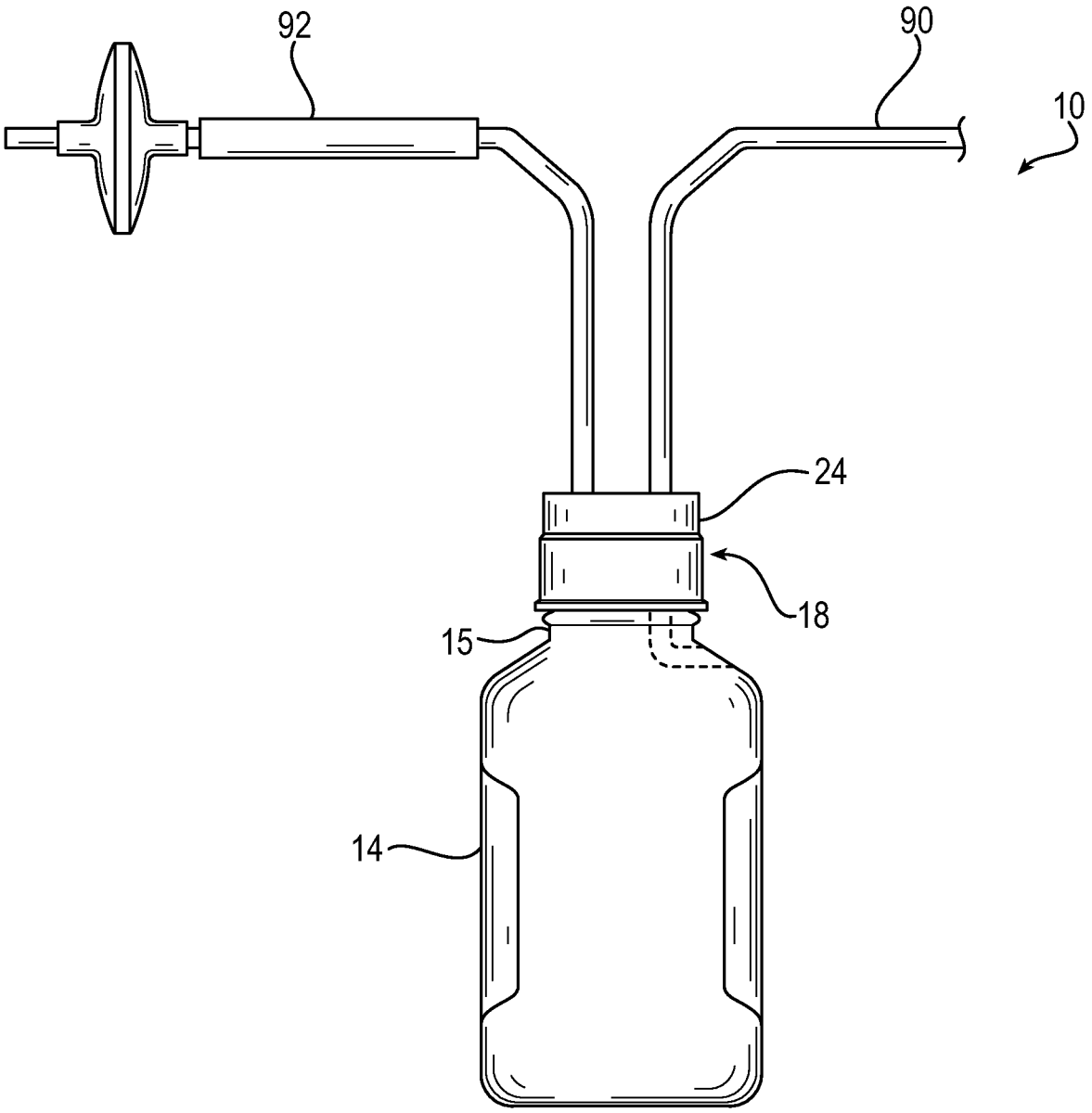
FIG. 1 is an elevated perspective view of a container system constructed according to the principles of the present invention.
Figure 2:
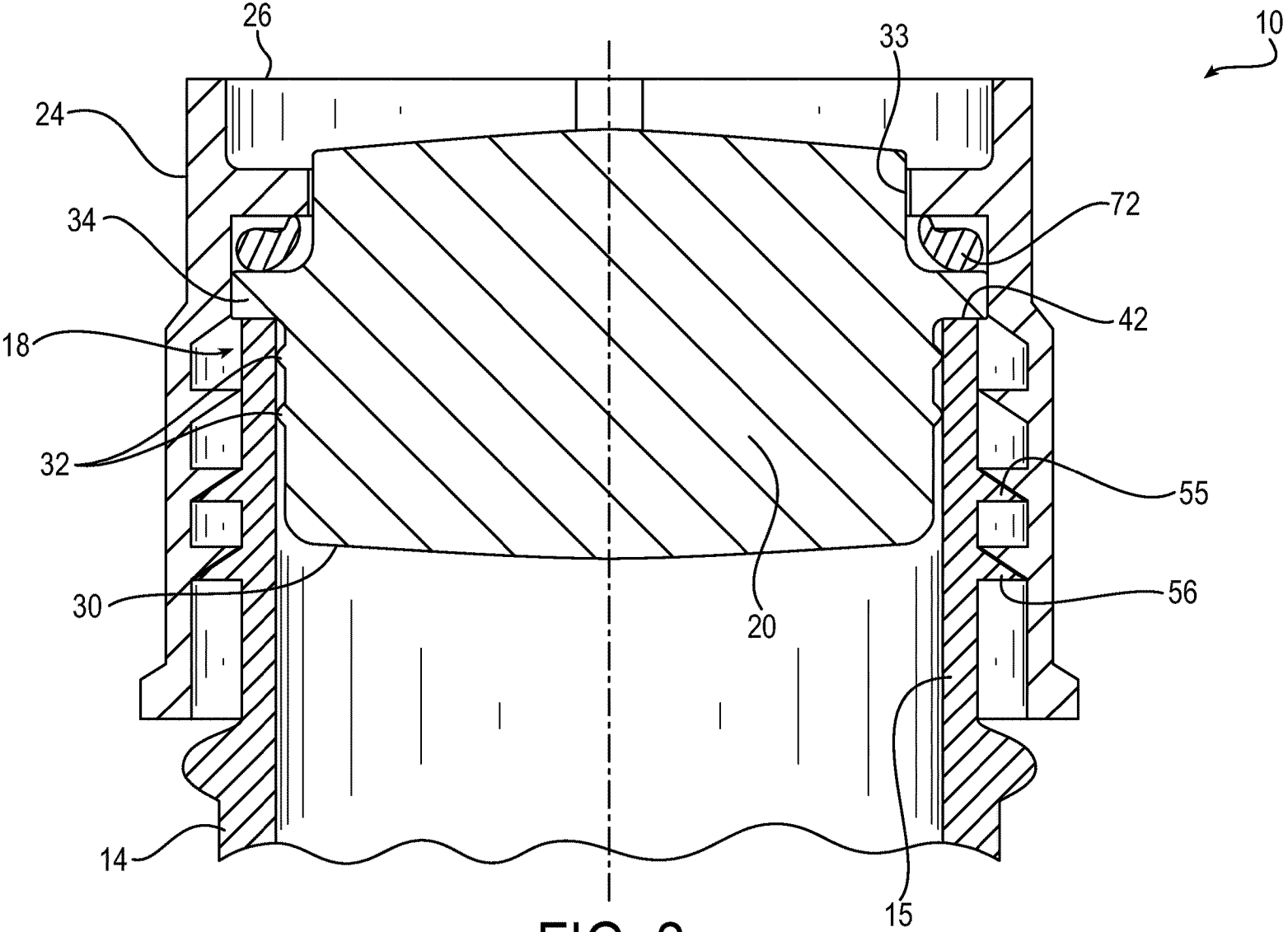
FIG. 2 is a cross-sectional side view of the upper portion of the container system of FIG. 1 with tubing removed.

Referring now to FIGS. 1 and 2, a container system is illustrated generally at 10, having a container body 14 with an elongated neck 15 with an annular mouth, indicated generally at 18, circumscribing a central axis, a resilient stopper 20 and a cap 24 with a central opening 26. The stopper has a circular body portion 30 closely received within the mouth and extending down into the neck, and can have one or more radially-projecting ribs 32 circumscribing the outer surface of the stopper which compress in a sealing manner against the inner surface of the neck. The stopper has a distal end 33 which extends a short distance outwardly from the mouth and includes a radial flange 34 circumscribing the stopper.

Figure 3:
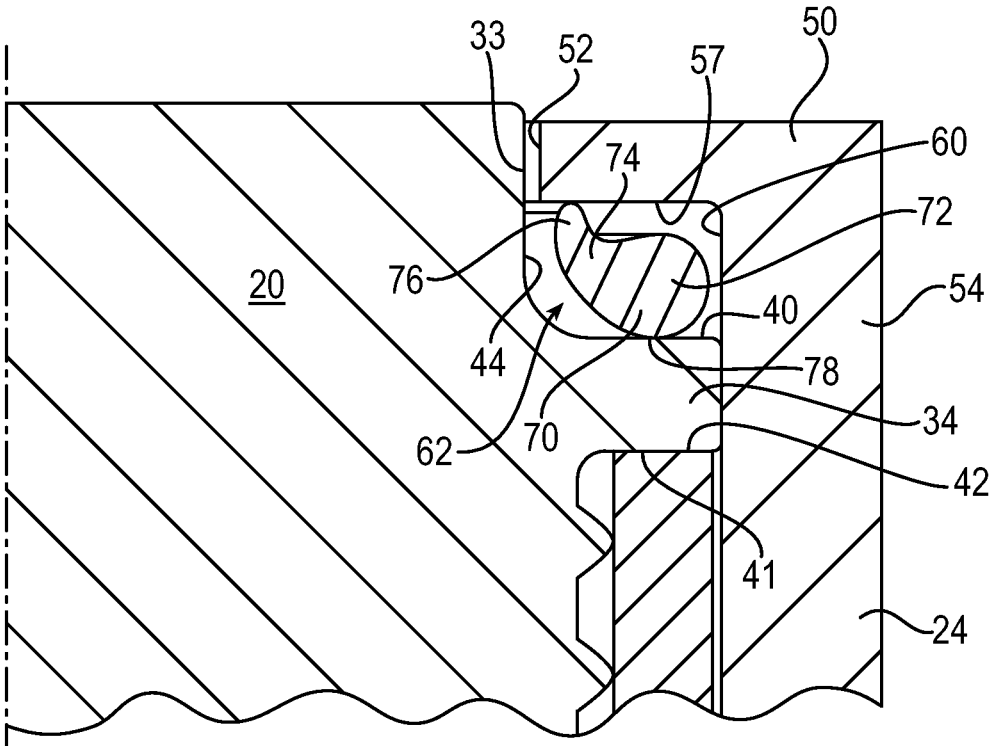
FIG. 3 is a cross-sectional schematic side view of a portion of the container system of FIG. 1, where the spring element is shown in a first embodiment with one energized configuration.

As shown also in FIG. 3, the flange 34 has an axially-outward facing annular flat surface 40 and an axially-inwardly facing annular flat surface 41. Flange 34 is located between the distal end 42 of the mouth and the cap 18 when the container system is assembled, with the axially-inwardly facing surface 41 in engagement with the distal end 42 of the mouth. The distal end 33 of the stopper has a radially-outward facing annular surface 44, which together with the axially-outwardly facing surface 40 of the flange, defines an outwardly-facing shoulder.

The cap 24 has a cup-shaped configuration with an annular end wall 50 circumscribing a central opening 52, and an annular side wall 54. Side wall 54 includes internal threads or flights 55 which cooperate with external threads or flights 56 on the neck 15 of the container to secure the cap onto the container. The end wall has an annular flat, axially-inwardly facing surface 57, which together with a radially-inwardly facing surface 60 of the side wall 54, defines an inwardly-facing shoulder in opposed relation to the outwardly facing shoulder of the stopper, with the axially-inwardly facing surface 57 of the cap in opposed relation to the axially-outwardly facing surface 40 of the flange of the stopper. An annular channel, indicated generally at 62, is defined between the surfaces of the stopper and cap.

An annular spring element 70 is located in the channel 62 between the cap and stopper, and according to a first embodiment, has a unitary, tear-drop shaped geometry in cross-section with a radially-outer, rounded bulbous body portion 72 smoothly tapering along a neck portion 74 to a curved, radially-inwardly projecting lip 76.

The spring element is preferably comprised of a resilient, high-performance thermoplastic polymer, such as polyketone or similar material such as polyether ether ketone, polyphenylsulfone or polycarbonate, which is capable of maintaining its pliancy and shape over a wide temperature range. An appropriate polyketone is available from Parker Hannifin GmbH, Bietigheim-Bissingen Germany, under the tradename Nobrox®. Again, other high-performance, chemically-resistant and biologically compatible material that maintains its pliancy and compression across wide temperature ranges may be appropriate depending on the particular application. The spring element is preferably formed (molded) in one unitary piece from a single material, but could be formed in multiple connected pieces of the same or different material as should be appreciated by those skilled in the art.

Figure 4:
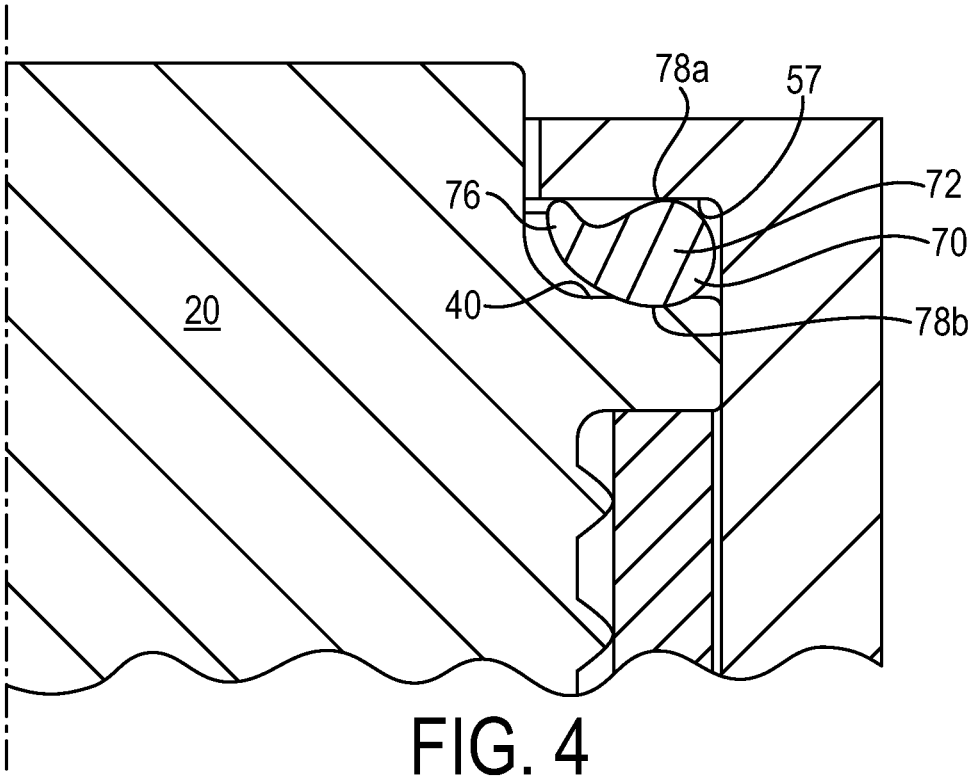
FIG. 4 is a cross-sectional side view of a portion of the container system of FIG. 1, where the spring element is shown in another energized configuration.

The spring element 70 is located in the channel such that the element has at least an axially inner surface or edge 78 of the bulbous body portion 72 sealingly engaged with the axially-outward facing surface 40 of the flange, and an outer surface or edge 80 of the lip 76 sealingly engaged with the axially inwardly-facing surface 57 of the cap. As shown in FIG. 3, the spring element has a configuration that defines two points of contact between the cap and the stopper; although as shown in FIG. 4, the element 70 could be configured to have three points of contact with opposite sides or edges 78*a*, 78*b* of the bulbous portion 72 sealingly engaging the axially inwardly-facing surface 57 of the cap 50 and the axially-outwardly facing surface 40 of the flange of the stopper, and the lip 76 separately sealingly engaging the axially inwardly-facing surface 57 of the cap.

The stopper, cap, tubing and container can be formed of materials which are non-reactive to the liquids being stored and transported, and can withstand many of the typical operating conditions so that the contents of the container remain sterile and do not leak. Typical materials for the stopper include resilient plastics and elastomers such as polyether ketones, thermoplastic or silicone. Typical materials for the tubing include polycarbonate (e.g., silicone) or equivalent, while typical materials for the container include glass, plastic or other polymer such as polyethylene (e.g., Nalgene®), in a rigid (e.g., bottle-shaped) or flexible (e.g., a bag) form. The cap can be formed of a polymer such as plastic, elastomer, or other appropriate material. The stopper, cap, tubing and container can be formed using conventional techniques, such as molding and extruding.

When the container system is assembled, the stopper 20 is inserted into the mouth of the container with the flange 34 located against the distal end 42 of the mouth. The distal end 33 of the stopper extends outwardly a short distance from the container body. The spring element 70 can be located in the cap against the axially-inwardly facing surface 57, and when the cap is screwed down onto the mouth of the container, the cap captures the flange 34 between the inner axial surface 57 of the cap and the distal end 42 of the mouth. Locating the spring element within the cap enables the cap and spring element to be preassembled as a closure assembly, and sterilized for use. Alternatively, the spring element can be initially located around distal end of the stopper, against the flange. In any event, when the cap is screwed onto the mouth of the container, the cap compresses the spring element 70 within the channel between the cap and the flange, which causes the spring element to compressively urge the stopper 20 inwardly against the mouth of the container, and hence urge the flange 34 against the distal end of the mouth. The compressive resiliency of the spring element maintains the seal between the flange of the stopper and the mouth of the container and also maintains a seal between the flange and the inside surface of the cap, even during low temperatures and cycling over a wide temperature range.

As indicated above, the cap 24 includes a central opening 26 in its end, which enables flexible tubing to be inserted into through-holes in the stopper to enable liquid to be introduced and withdrawn from the container. While shown as separate pieces, the tubes could likewise be formed in one piece with (unitarily) with the stopper.

During use, the liquid is introduced through a feed tube 90 (FIG. 1) under aseptic conditions into a cleaned and sterilized container, with a vent tube 92 enabling air within the container to escape. The tubes are then closed, a protective over cap (not shown) is applied to the cap, and the container can be irradiated (if appropriate) and frozen for storage and transport. When it is desired to remove the contents of the container, the container is thawed, the tubes are re-opened, and the liquid is recovered.

Although not separately described, the container, cap, stopper and tubing can be sterilized, irradiated and otherwise cleaned before and during use to create an aseptic environment, as should be known to those skilled in the art. The stopper, tubing, container and cap can also be cleaned and reused if appropriate, but are typically disposed after a single use.

According to other embodiments, the seal can have other asymmetrical shapes besides tear-drop shaped which provide a bias against the flange of the stopper, and hence maintain the flange in sealing relation against the distal end of the mouth of the container and a seal between the flange and the inside surface of the cap at low temperatures and when the container is cycled from low temperature to ambient.

Figure 5:
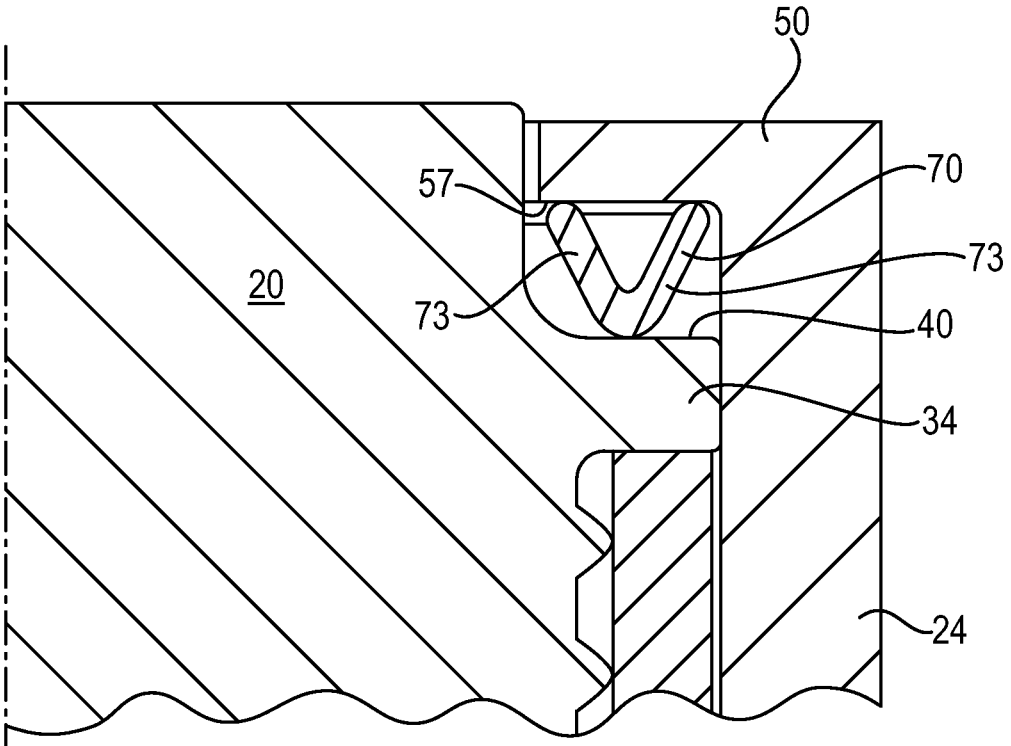
FIG. 5 is a cross-sectional side view of a portion of the container system, showing a second embodiment of the spring element.

For example, FIG. 5 shows a second embodiment of the spring element 70 which has a V shape in cross-section. In such embodiment, the spring element has a pair of outwardly projecting legs 73, with the distal ends engaging the cap 24, and the intersection of the legs engaging the flange 34 of the stopper 20. As with the first embodiment above, the spring element is located and compressed between the axially-inwardly facing surface 57 of the outer wall 50 of the cap 24, and the axially-outwardly facing surface 40 of the flange 34 of the stopper 20, when the cap is screwed onto the container. The spring element is shown having three points of contact—two at the distal ends of the legs of the V against the cap; and one at the intersection of the legs of the V against the flange 24. When the cap 24 is screwed down on the container 14, the cap urges the spring element into compressed engagement with the flange of the stopper, which maintains the flange in sealing relation with the distal end of the mouth of the container as well as maintains a seal between the flange and the cap.

Figure 6:
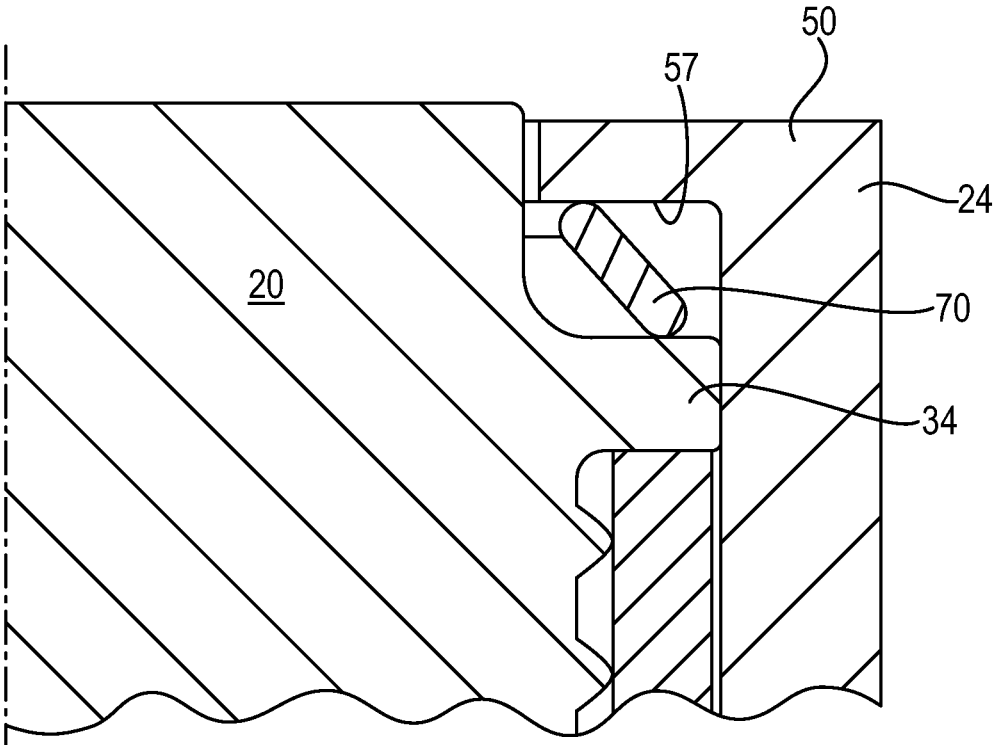
FIG. 6 a cross-sectional side view of a portion of the container system, showing a third embodiment of the spring element.

FIG. 6 shows a third embodiment of the spring element 70 having a conical configuration. This spring element is likewise positioned between the cap 24 and flange 34 of the stopper 20, but only has two opposite points of contact.

Figure 7:
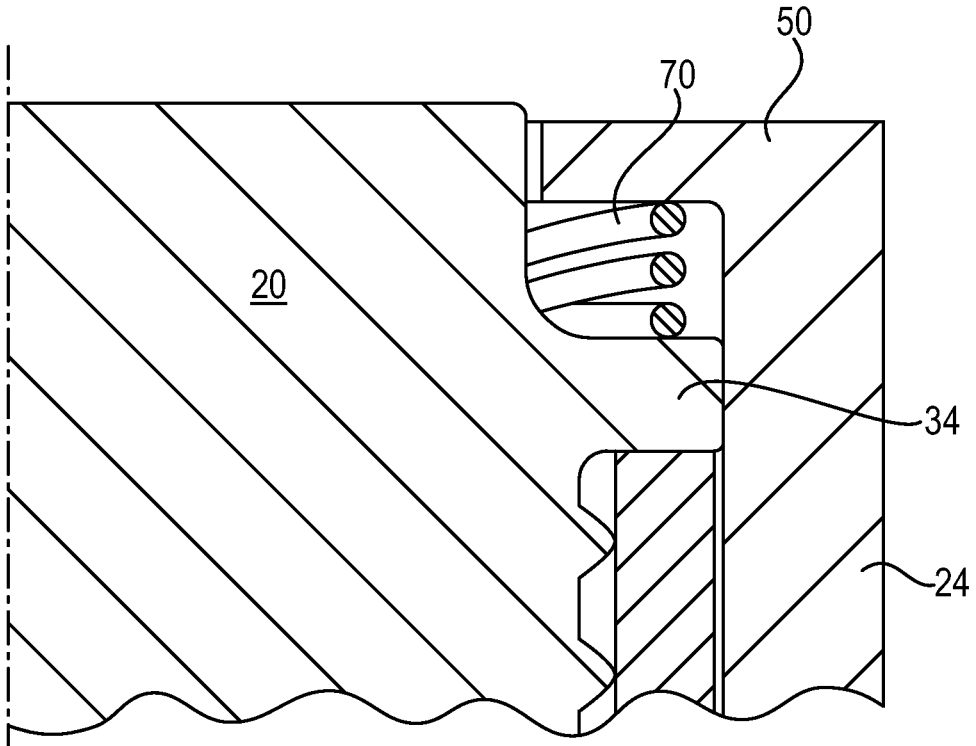
FIG. 7 is a cross-sectional side view of a portion of the container system, showing a fourth embodiment of the spring element.

FIG. 7 shows a fourth embodiment of the spring element 70 having a helical configuration, with a single flight of the spring circumscribing the distal end of the stopper. This spring element is likewise positioned between the cap 24 and flange 34 of the stopper 20, with two points of contact.

Figure 8:
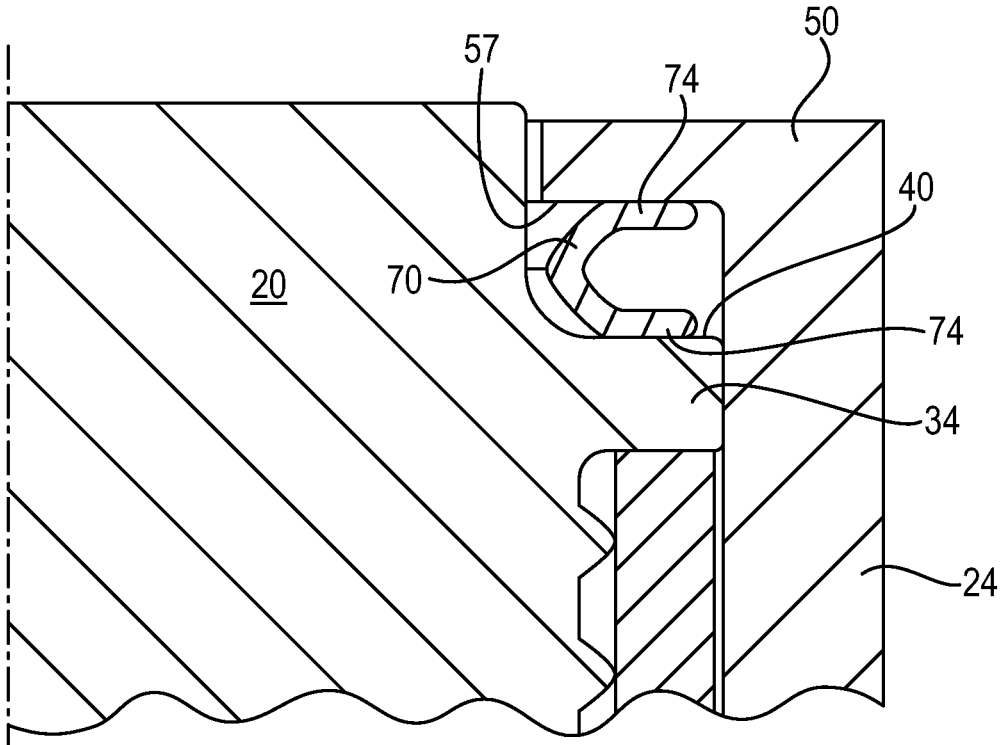
FIG. 8 is a cross-sectional side view of a portion of the container system, showing a fifth embodiment of the spring element.

FIG. 8 shows a fifth embodiment of the spring element 70 with a C-shaped configuration, with the legs 74 of the spring element respectively engaging along two opposite side surfaces of the legs the axially-inwardly facing surface 57 of the cap 24 and the axially-outwardly facing surface 40 of the flange 34 of the stopper 20.

Figure 9:
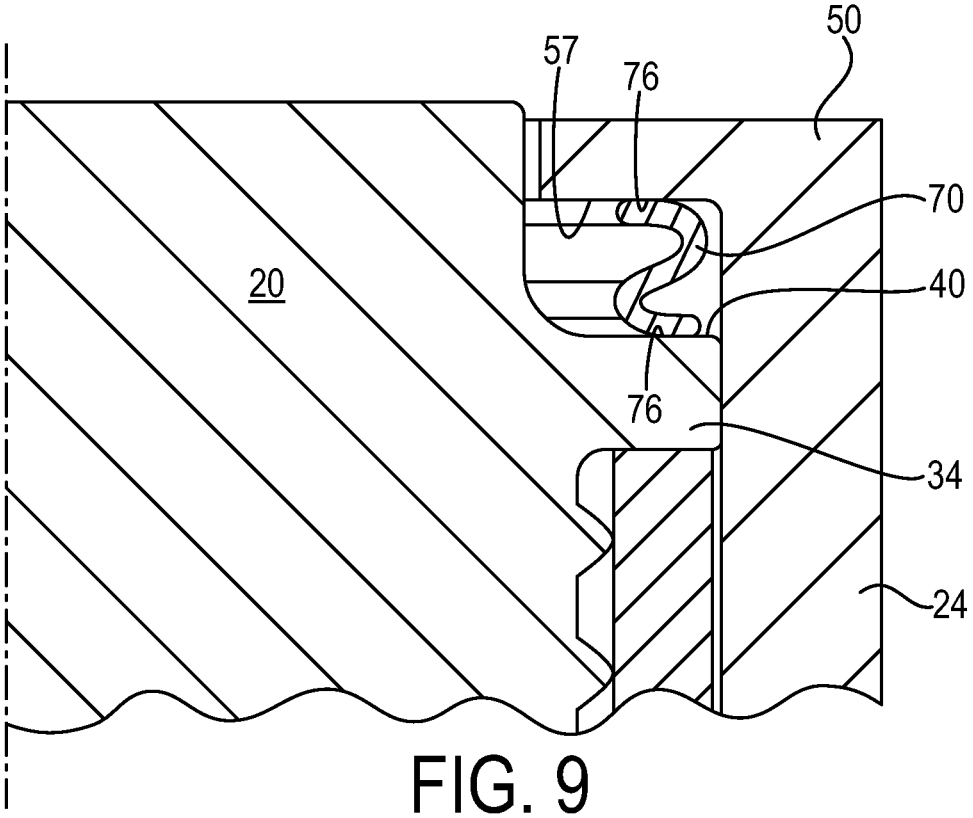
FIG. 9 is a cross-sectional side view of a portion of the container system, showing a sixth embodiment of the spring element.

FIG. 9 shows a sixth embodiment of the spring element 70 having an S-shaped configuration also with two points of contact along the side surfaces 76 of the distal ends of the spring element against the axially-inwardly facing surface 57 of the cap 24 and the axially-outwardly facing surface 40 of the flange 34 of the stopper 20.

Again, spring elements having other asymmetrical configurations are possible as should be appreciated by those skilled in the art, where the spring element has a configuration that urges the flange of the stopper against the distal end of the mouth of the container and maintains a seal also between the flange and the cap even during low temperatures and cycling between low temperatures and ambient.

Thus, as described above, a container system for liquids is provided which has an improved seal between the stopper and container which prevents leakage during low temperature storage and transport, and later use at ambient temperatures. The container system remains simple to manufacture and assemble, and relatively inexpensive to construct, as the stopper can continue to be made of low-cost, non-reactive resilient material, such as silicone or a similar material; while the spring element can be separately formed in different configurations and out of more expensive, high-performance materials, but overall, the system is capable of meeting the operational requirements of many biological and pharmaceutical applications.

The principles, preferred embodiments and modes of operation of the present invention have been described in the foregoing specification. The invention which is intended to be protected herein should not, however, be construed as limited to the particular form described as it is to be regarded as illustrative rather than restrictive. Variations and changes may be made by those skilled in the art without departing from the scope and spirit of the invention as set forth in the appended claims.

What is claimed is:

1. A container system for liquids, the container system comprising:

a. a container body with a mouth circumscribing a central axis;

b. a resilient stopper having a body portion closely received within the mouth of the container and a distal end projecting outwardly from the mouth, the distal end having an annular flange projecting radially outward from the distal end and having an axially-inwardly facing surface and axially-outwardly facing surface, with the axially inwardly facing surface in sealed engaging relationship against a distal outer end of the mouth;

c. a cap secured over the mouth of the container body and enclosing the distal outer end of the stopper, the cap including an axially-inwardly facing surface, wherein a channel is defined between the axially-inwardly facing surface of the cap and the axially-outward facing surface of the flange of the stopper; and d. a spring element located in the channel, the spring element comprised of a resilient polymer and having a shaped geometry in cross-section defining at least two separate points of contact between the stopper and cap within the channel, wherein the spring element provides axial compression against the flange of the stopper to maintain the flange in sealing relationship with the distal end of the mouth of the container and maintains a seal between the stopper and cap.

2. The container system as in claim 1, wherein the spring element has at least two separate points of contact between the cap and the flange of the stopper.

3. The container system as in claim 2, wherein the spring element has three separate points of contact between the cap and the flange.

4. The container system as in claim 1, wherein the spring element has a rounded bulbous body portion tapering to a curved, radially-inwardly projecting lip.

5. The container system as in claim 4, wherein the spring element is located between the cap and stopper with the bulbous portion having a surface sealingly engaged with the axially outwardly-facing surface of the flange, and the lip is sealingly engaged with the axially inwardly-facing surface of the cap.

6. The container system as in claim 5, wherein the bulbous portion has opposite surfaces sealingly engaged with and between the axially outwardly-facing surface of the flange and the axially inwardly-facing surface of the cap.

7. The container system as in claim 1, wherein the spring element has an asymmetric shape in cross-section sealing against the flange of the stopper and the cap.

8. The container system as in claim 7, wherein the spring element has a cone, helical, V, S or C shaped configuration in cross-section.

9. The container system as in claim 1, wherein the spring element has an annular, unitary configuration.

10. The container system as in claim 1, wherein the spring element is polyketone.

11. The container system as in claim 1, wherein the stopper is silicone.

12. The container system as in claim 1, wherein the distal end of the stopper has a radially-outward facing surface, which together with the axially-outwardly facing surface of the flange, defines an outwardly-facing shoulder, and the cap has a radially-inwardly facing surface which together with the axially-inwardly facing surface of the cap, defines an inwardly-facing shoulder in opposed relation to the outwardly facing shoulder of the stopper and defining the channel.

13. The container system as in claim 1, wherein the body portion of the stopper includes one or more ribs circumscribing an outer surface of the stopper.

14. The container system as in claim 1, wherein the cap has a cup-shaped body with a central opening.

15. The container system as in claim 1, wherein the cap and container body each include a threaded connection.

16. The container system as in claim 1, further including one or more tubes extending through the stopper in fluid-tight relationship therewith to enable fluid to be introduced and/or removed from the container body.

17. The container system as in claim 1, wherein the spring element sealingly engages the axially-inward facing surface of the cap and the axially-outward facing surface of the flange on the stopper.

18. A method for assembling a container assembly comprising i) a container body with a mouth circumscribing a central axis; ii) a resilient stopper having a body portion and a distal end, an annular flange projecting radially outward from the distal end of the stopper and having an axially-inwardly facing surface and axially-outwardly facing surface; iii) a cap including an axially-inwardly facing surface; and a spring element comprised of a resilient polymer, the method comprising the steps of:

a. inserting the stopper into the mouth of the container body such that the distal end of the stopper extends outwardly from the container body and the flange of the stopper is located in engagement with a distal end of the mouth of the container;

b. locating the spring element in the cap against the axially-inwardly facing surface of the cap;

c. securing the cap over the mouth of the container body so as to enclose the distal outer end of the stopper and compressing the spring element between the cap and the flange of the stopper, the spring element being located in a channel defined between the axially-inward facing surface of the cap and the axially-outward facing surface of the stopper and the spring element having at least two separate points of contact between the axially-inwardly facing surface of the cap and the axially-outward facing surface of the flange and urging the flange into sealing relation against the distal end of the mouth of the container and maintaining a seal.

19. The method as in claim 18, wherein the spring element has three separate points of contact between the axially-inwardly facing surface of the cap and the axially-outward facing surface of the flange.

20. The method as in claim 18, wherein the spring element is polyketone.

21. A container system for liquids, the container system comprising:

a. a container body with a mouth circumscribing a central axis;

b. a resilient stopper having a body portion closely received within the mouth of the container, a distal end projecting outwardly from the mouth, and an annular flange projecting radially outward from the distal end, the distal end of the stopper having a radially-outwardly facing surface, and the flange having an axially-inwardly facing surface and axially-outwardly facing surface, with the axially-inwardly facing surface in sealed engaging relationship against a distal outer end of the mouth and the axially-outwardly facing surface together with the radially-outwardly facing surface of the distal end defining an outwardly-facing shoulder;

c. a cup-shaped cap threadably secured over the mouth of the container body and enclosing the distal outer end of the stopper, the cap including a radially-inwardly facing surface and an axially-inwardly facing surface, which together define an inwardly-facing shoulder in opposed relation to the outwardly facing shoulder of the stopper and defining a channel;

d. an annular spring element located in the channel, the spring element comprised of a resilient polymer and having a shaped geometry in cross-section defining at least two separate points of contact between the flange of the stopper and the cap within the channel, wherein the spring element provides axial compression against the flange of the stopper to maintain the flange in sealing relationship with the distal end of the mouth of the container, and provides a seal between the flange and the cap.

22. The container system as in claim 21, wherein the spring element has a rounded bulbous body portion tapering to a curved, radially-inwardly projecting lip.

23. The container system as in claim 22, wherein the spring element is located between the cap and stopper with the bulbous portion having a surface sealingly engaged with the axially outwardly-facing surface of the flange, and the lip is sealingly engaged with the axially inwardly-facing surface of the cap.

24. The container system as in claim 23, wherein the bulbous portion has opposite surfaces sealingly engaged with and between the axially outwardly-facing surface of the flange and the axially inwardly-facing surface of the cap.

25. The container system as in claim 21, wherein the spring element has an asymmetric shape in cross-section sealing against the flange of the stopper and the cap.

26. The container system as in claim 25, wherein the spring element has a cone, helical, V, S or C shaped configuration in cross-section.

27. The container system as in claim 21, wherein the spring element is polyketone.

28. The container system as in claim 21, wherein the stopper is silicone.

29. The container system as in claim 21, wherein the body portion of the stopper includes an outer surface with one or more ribs surrounding and unitary with an outer surface of the stopper.

30. The container system as in claim 21, further including one or more tubes extending through the stopper in fluid-tight relationship therewith to enable fluid to be introduced and/or removed from the container body.

31. A closure assembly for a container having a mouth, the closure assembly comprising:

a. a resilient stopper having a body portion with a configuration adapted to be closely received within the mouth of the container and with a distal end extending outwardly from the mouth, the distal end having an annular flange projecting radially outward from the distal end and having an axially-inwardly facing surface and axially-outwardly facing surface;

b. a cap configured to be secured over the mouth of the container body enclosing the distal outer end of the stopper, the cap including an axially-inward facing surface which together with the axially-outward facing surface of the stopper, define a channel when the stopper, cap and container are assembled with the stopper located in the mouth of the container body and the cap secured over the mouth; and c. a spring element located in the cap against the axially-inwardly facing surface and located so as to be situated in the channel when the stopper, cap and container are assembled, the spring element comprised of a resilient polymer and having a shaped geometry in cross-section, the spring element having at least one point of contact with the axially-inwardly facing surface of the cap, and also a point of contact with the flange of the stopper so as to provide axial compression against the flange of the stopper to maintain the flange in sealing relationship with the distal end of the mouth of the container and a seal between the stopper and cap when the stopper, cap and container are assembled.

32. The container system as in claim 21, wherein the spring element sealingly engages the axially-inward facing surface of the cap and the axially-outward facing surface of the flange on the stopper.

33. The container system as in claim 21, wherein the spring element has three separate points of contact between the cap and the flange.

34. The closure assembly as in claim 31, further including one or more tubes extending through the stopper in fluid-tight relationship therewith to enable fluid to be introduced and/or removed from the container body.

35. The container system as in claim 31, wherein the spring element sealingly engages the axially-inward facing surface of the cap and the axially-outward facing surface of the flange on the stopper.

36. The closure assembly as in claim 31, wherein the spring element has three separate points of contact between the cap and the flange.

37. The closure assembly as in claim 31, wherein the spring element is polyketone.

38. A container system for liquids, the container system comprising:

a. a container body with a mouth circumscribing a central axis;

b. a resilient stopper having a body portion closely received within the mouth of the container and a distal end projecting outwardly from the mouth, the distal end having an annular flange projecting radially outward from the distal end and having an axially-inwardly facing surface and axially-outwardly facing surface, with the axially inwardly facing surface in sealed engaging relationship against a distal outer end of the mouth;

c. a cap secured over the mouth of the container body and enclosing the distal outer end of the stopper, the cap including an axially-inwardly facing surface, wherein a channel is defined between the axially-inwardly facing surface of the cap and the axially-outward facing surface of the flange of the stopper; and d. a spring element located in the channel, the spring element comprised of a resilient polymer with a shaped geometry in cross-section and having at least two separate points of contact between the axially-inward facing surface of the cap and the axially-outward facing surface of the stopper within the channel, wherein the spring element provides axial compression against the flange of the stopper to maintain the flange in sealing relationship with the distal end of the mouth of the container.

39. The container system as in claim 38, wherein the spring element has a helical configuration.

* * * * *